US006174055B1

(12) United States Patent
Sugikubo et al.

(10) Patent No.: US 6,174,055 B1
(45) Date of Patent: Jan. 16, 2001

(54) INK JET PRINTING APPARATUS

(75) Inventors: Toshihiro Sugikubo, Tokyo; Hiroyuki Miyake; Norio Tsurui, both of Kawasaki, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/891,790

(22) Filed: Jul. 14, 1997

(30) Foreign Application Priority Data

Jul. 15, 1996 (JP) ..... 8-185064
Jul. 26, 1996 (JP) ..... 8-197978

(51) Int. Cl.[7] ..... B41J 2/18; B41J 29/377; B41J 2/375

(52) U.S. Cl. ..... 347/89; 347/18; 347/223

(58) Field of Search ..... 347/89, 18, 37, 347/85–87, 223; 5/482

(56) References Cited

U.S. PATENT DOCUMENTS

| | | | | |
|---|---|---|---|---|
| 1,177,952 | * | 4/1916 | Inman | 5/482 |
| 4,323,907 | * | 4/1982 | Italiano | 347/85 |
| 4,340,895 | * | 7/1982 | Kikuchi | 347/89 |
| 4,677,448 | * | 6/1987 | Mizusawa et al. | 347/85 |
| 4,896,172 | * | 1/1990 | Nozawa et al. | 347/18 |
| 5,211,493 | | 5/1993 | Stephenson et al. | 400/719 |
| 5,367,328 | * | 11/1994 | Erickson | 347/85 |
| 5,402,160 | | 3/1995 | Kadowaki et al. | 347/18 |

FOREIGN PATENT DOCUMENTS

| | | | |
|---|---|---|---|
| 2-34355 | | 2/1990 | (EP) . |
| 629508 | | 12/1994 | (EP) . |
| 693587 | | 1/1996 | (EP) . |
| 700790 | | 3/1996 | (EP) . |
| 736390 | | 10/1996 | (EP) . |
| 4-21457 | | 1/1992 | (JP) . |
| 6-182986 | * | 7/1994 | (JP) ..... 347/18 |
| 8-276573 | | 10/1996 | (JP) . |

* cited by examiner

*Primary Examiner*—N. Le
*Assistant Examiner*—Judy Nguyen
(74) *Attorney, Agent, or Firm*—Fitzpatrick, Cella, Harper & Scinto

(57) ABSTRACT

An ink jet printing apparatus having liquid passages arranged for causing liquid to flow while coming in contact with ink jet heads includes a liquid accumulating section for accumulating liquid therein, a pump for feeding the liquid, a first connecting passage for connecting the liquid accumulating section to inlet portions of the liquid passages, a second connecting passage for connecting outlet portions of the liquid passages to the suction side of the pump, and a third connecting passage for connecting the liquid accumulating section to the pump discharge side. With such construction, cooling liquid W of which temperature is controlled in the liquid accumulating section is fed to the liquid passages with negative pressure.

20 Claims, 9 Drawing Sheets

INK JET PRINTING APPARATUS

BACKGROUND OF THE INVENTION

1. Field of the Invention

The present invention relates to an ink jet printing apparatus for performing a printing operation by ejecting liquid such as ink or the like from ejecting ports in the form of ejected liquid droplets and allowing the liquid droplets to adhere to a printing medium such as paper, cloth, unwoven cloth, OHP paper or the like. More particularly, the present invention relates to an ink jet printing apparatus for continuously performing a printing operation for a printing medium having a large width for a long time like an industrial textile printing apparatus.

As concrete applicable instruments and apparatuses of the present invention, a textile printing apparatus, a large-sized printer and so forth can be noted.

The term "printing" mentioned in this specification with reference to the accompanying drawings is used not only for representing an operation for imparting ink to a printing medium such as paper or the like but also for widely representing an operation for imparting to the printing medium adequate liquid containing pigment and dyestuff.

2. Description of the Related Art

From the viewpoint that a high speed printing operation can quietly be performed at a low running cost, many ink jet printing apparatuses are used as a printing section for a printer, facsimile, copying machine or the like, and in accordance with the ink jet printing process, a printing operation is performed by ejecting ink from a plurality of ink ejecting ports in response to a printing data signal and then causing liquid droplets to adhere to a printing medium.

In general, the viscosity of ink used for the ink jet printing apparatus varies depending on the temperature. As the ink viscosity varies, a quantity of ink ejection at the time of each printing operation varies, causing the diameter of ink dot adhering to the printing medium to vary. Since the variation of the dot diameter is not recognized by human being's eyes as long as the variation of the ink viscosity is kept small, there does not arise a practical problem. However, in the case that the ink viscosity varies largely, this is recognized as variation of density, resulting in a problem that desired printing density can not be obtained.

In the case that the dot diameter varies depending on the place on a same printing medium, there arises a problem that this is recognized as so-called density fluctuation. For this reason, it is desirable that the temperature of ink is controlled within the range of certain extent (the range that the variation of density can not be recognized by human being's eyes) from the viewpoint that both requirements for stabilization of printing quality and cost reduction by simple controlling are satisfactorily met.

A method of controlling the temperature of ink is actually practiced in the form of temperature controlling for the printing heads. With this method, the variation of the environment temperature in the proximity of the ink jet printing apparatus is considered as a factor for inducing the temperature variation of printing heads, but generally, since the ink jet printing apparatus is often used at a room temperature (ranging from about 20 to 25° C.), the environment temperature is kept comparatively stable. Rather, many factors for inducing the temperature variation of the printing heads consist in elevation of the temperature caused by heat generation at the time of driving of the printing heads. For example, in the case of a serial printer, since a quantity of heat accumulated in the printing heads is different at the time of starting of a printing operation as well as at the time of completion of the printing operation during single scanning, there arises an occasion that the dot diameter is different at the time around the starting of the printing operation as well as at the time around the completion of the printing operation.

Generally, in a printer for a printing medium having a comparatively narrow width like a printer for an A-4 sized width or a printer adapted to operate at a comparatively slow printing speed, fluctuation of the dot diameter between the time around the starting of the printing operation and the time around the completion of the printing operation can be suppressed to an extent that the foregoing fluctuation can not visually be recognized by human being's eyes, merely by disposing a heater and a temperature detecting sensor in the printing head so as to optimize the temperature of the printer head by controlling the driving of the heater in response to a signal transmitted from the temperature detecting sensor.

However, in a printer having a wide printing width or a printer adapted to operate at a high printing speed, the fluctuation of the dot diameter between the time around the starting of the printing operation and the time around the completion of the printing operation is additionally enlarged. Thus, when the controlling method as mentioned above is practiced, the fluctuation of the dot diameter is visually recognized as density fluctuation by human being's eyes, and this leads to a problem that quality of each printing operation is degraded.

As a measure for solving the foregoing problem, there is existent a method of controlling a printing head within a predetermined adequate temperature range by allowing specific cooling liquid such as water or the like to come in contact with the printing head. This method is such that the specific cooling liquid such as water or the like is sucked, pressurized and discharged by driving a pump so that the printing head is cooled by causing the cooling liquid to come in contact with the printing head via a liquid passage such as a tube or the like.

However, in the case that such pressurized liquid is used, when leakage of the liquid from the liquid passage to the atmosphere occurs due to deterioration of the tube as time elapses or for an unexpected reason, there appears a fear that the liquid leaks from the liquid passage to the outside, causing the liquid to adhere to the printing medium. When the liquid adheres to the printing medium before printing operation or after printing operation, printed images are contaminated with the leaked liquid in either case.

In general, when liquid is sucked, pressurized and discharged by driving a pump, the temperature of the liquid is elevated because of generation of heat from the pump. On the assumption that a quantity of elevation of the temperature is represented by $\delta tp$, when the liquid of which temperature is controlled to temperature T by temperature controlling means is sucked by the pump and discharged from the same, the temperature of the liquid discharged from the pump becomes $T+\delta tp$.

In the case that the temperature of an ink jet head is controlled by feeding the liquid accumulated in a liquid accumulating section to a liquid passage of the ink jet head while the temperature of the liquid is controlled to the temperature T by the temperature controlling means, when the liquid of which temperature is controlled to the temperature T is discharged from the pump and fed to the ink jet head as it is sucked by driving the pump, the temperature of the liquid fed to the ink jet head becomes $T+\delta tp$, and the temperature of the ink jet head can not be controlled to the temperature T which is a desired temperature. In this case, it is considered that the temperature of the ink jet head may be controlled to the temperature T+δtp. In general, however, values of temperature T and a quantity δtp of elevation of temperature are not constant but they fluctuate. For this reason, when the liquid of which temperature is controlled to the temperature T is fed to the ink jet head while it is sucked by the pump and discharged from the same, fluctuation of the temperature is enlarged by the quantity δtp of elevation of temperature achieved by the pump.

On the other hand, in the case that a feeding tube for the temperature controlling liquid in the printing head is arranged while it comes in direct contact with the printing head, since the feeding tube is displaced in the scanning direction as the printing head is reciprocably displaced in the scanning direction at the time of printing operation, the feeding tube is frequently bent and vibration caused by the frequent bending of the feeding tube is transmitted to the printing head. Consequently, the scanning speed of the printing head becomes unstable, causing a malfunction such as ink density fluctuation or the like to occur at the time of printing operation.

In addition, when a negative pressure pump is used for the purpose of recirculation of the liquid, it is necessary that the feeding tube has sufficient rigidity so as to assure that the feeding tube does not collapse under the influence of negative pressure generated by suction of the negative pressure pump. Thus, vibration caused by bending of the feeding tube is additionally enlarged with the result that the quality of printed images is largely adversely affected.

SUMMARY OF THE INVENTION

An object of the present invention is to provide an ink jet printing apparatus which assures that contamination of a printing medium can be prevented without any occurrence of liquid leakage and the temperature of each ink jet head can be controlled with high accuracy so that each printing operation can be performed at high quality.

Another object of the present invention is to provide an ink jet printing apparatus which assures that the influence of vibration induced at the time of reciprocable displacement of the ink jet head can be reduced so that quality of images can be improved while the ejection of the ink is stabilized.

In a first aspect of the present invention, there is provided an ink jet printing apparatus having a liquid flow passage arranged while coming in contact with an ink jet head for causing liquid to flow therethrough, comprising:

- a liquid accumulating section in which the liquid is accumulated;
- a pump including a suction side and a discharge side for feeding the liquid;
- a first connecting passage for connecting the liquid accumulating section to an inlet of the liquid flow passages;
- a second connecting passage for connecting an outlet of the liquid flow passage to the suction side of the pump, and
- a third connecting passage for connecting the liquid accumulating section to the discharge side of the pump.

Here, the ink jet printing apparatus may further comprise:

- temperature controlling means for controlling the temperature of the liquid accumulated in the liquid accumulating section.

The pump may be a pump which does not generate any pulsation.

The pump may be a peripheral pump.

The set temperature of the liquid controlled by the temperature controlling means may be substantially equal to the environment temperature at which the ink jet printing apparatus is arranged.

The difference between the set temperature of the liquid controlled by the temperature controlling means and the environment temperature at which the ink jet printing apparatus may be arranged is 5° C. or less.

The ink jet printing apparatus may comprise a carriage capable of mounting a plurality of ink jet heads thereon, the carriage being reciprocably displaceable in a direction different from a conveying direction of a printing medium,

- the first connecting passage may comprise a first main tube for connecting the liquid accumulating section to a first manifold immovably disposed on the carriage and a plurality of first sub-tubes for respectively connecting the first manifold to an inlet portion of a plurality of liquid passages on the ink jet heads, and
- the second connecting passage may comprise a plurality of second sub-tubes for respectively connecting an outlet portion of the plurality of liquid passages on the ink jet heads to a second manifold and a second main tube for connecting the second manifold to the suction side of the pump.

At least the first main tube and the second sub-tubes may have bending properties.

The ink jet head may comprise an element for generating thermal energy for generating film boiling in ink as energy to be utilized for ink ejection.

The printing medium may be a cloth, and a textile printing operation may be performed for the cloth.

The ink jet printed article may comprise: a printing medium printed by an ink jet printing apparatus.

The processed product may comprise: a product obtained by additionally processing the ink jet printed article.

The processed product may be obtained by cutting the ink jet printed article into pieces having desired sizes and carrying out for the cut pieces a step for obtaining a final processed product.

The step for obtaining the final processed product may be a sewing operation.

The processed product may be clothes.

In a second aspect of the present invention, there is provided an ink jet printing apparatus, comprising:

- a first carriage for mounting a printing head thereon,
- a liquid flow passage for causing cooling liquid to flow while coming in contact with the printing heads;
- cooling liquid recirculating and feeding means for feeding the cooling liquid by recirculation of the cooling liquid through the liquid flow passage; the cooling liquid recirculating and feeding means comprising:
  - a pump for feeding the cooling liquid,
  - a first connecting passage of which one end is connected to the pump and of which other end is connected to an inlet of the liquid flow passage, and
  - a second connecting passage of which one end is connected to the pump and of which other end is connected to an outlet of the liquid flow passage, and
  - a second carriage adapted to be driven in association with the first carriage and holding at least part of the first connecting passage and the second connecting passage.

Here, the ink jet printing apparatus may further comprise:

- a flow liquid accumulating section for accumulating the cooling liquid therein and a third connecting passage, wherein the first connecting passage serves to connect the liquid accumulating section to the inlet of the liquid passage, the second connecting passage serves to connect the outlet of the liquid passage to the suction side of the pump, and the third connecting passage serves to connect the discharge side of the pump to the liquid accumulating section.

The plurality of printing heads each having a liquid flow passage for causing cooling liquid to flow while coming in contact with printing heads attached thereto may be mounted on the first carriage.

The first connecting passage may comprise a first main tube for connecting the liquid accumulating section to a first manifold immovably fixed to the second carriage and a plurality of first sub-tubes for connecting the first manifold to inlet portions of liquid passages on the plurality of printing heads, and the second connecting passage may comprise a plurality of second sub-tubes for connecting outlet portions of a plurality of liquid flow passages on the printing heads to a second manifold immovably fixed to the second carriage and a second main tube for connecting the second manifold to the suction side of the pump.

At least the first main tube and the second main tube may be tubes each of which does not collapse under the influence of negative pressure and has bending properties.

At least the first sub-tubes and the second sub-tubes may be tubes each of which has flexibility.

The first connecting passage may comprise a plurality of first sub-tubes for connecting the liquid accumulating section to inlet portions of liquid passages on the plurality of printing heads and at least part of which is held on the second carriage, and the second connecting passage may comprise a plurality of second sub-tubes for connecting outlet portions of a plurality of liquid passages on the printing heads to a manifold immovably fixed to the second carriage and a main tube for connecting the manifold to the suction side of the pump.

The second carriage may further comprise a tray which is arranged so as to relatively move in the main scanning direction and associated with the first carriage, and at least part of the first connecting passage and the second connecting passage may be held on the tray.

The second carriage may further comprise a tray which is arranged so as to relatively move in the main scanning direction and associated with the first carriage, and the first manifold and the second manifold may be immovably fixed to the tray.

The ink jet printing apparatus may further comprise:

temperature controlling means for controlling the temperature of the cooling liquid accumulated in the liquid accumulating section.

According to an aspect of the present invention, an ink jet printing apparatus having a liquid passage arranged while coming in contact with an ink jet head for causing liquid to flow therethrough comprises a liquid accumulating section in which the liquid is accumulated, a pump for feeding the liquid, a first connecting passage for connecting the accumulating section to an inlet of the liquid flow passage, a second connecting passage for connecting an outlet of the liquid flow passage to the suction side of the pump, and a third connecting passage for connecting the liquid accumulating section to the discharge side of the pump. With this construction, the liquid does not leak even though a malfunction of leakage occurs for an unexpected reason in the first connecting passage, the second connecting passage and their connecting portions, whereby there does not appear a fear that a printing medium is contaminated with the leaked liquid.

According to another aspect of the present invention, the ink jet printing apparatus further comprises includes temperature controlling means for controlling the temperature of the liquid accumulated in the liquid accumulated section. Thus, the liquid of which temperature is controlled to desired temperature by the temperature controlling means can be fed to the liquid passage in the ink jet head at the substantially desired temperature so as to control the temperature of the head with sufficient precision.

According to a further aspect of the present invention, the pump employed for the ink jet printing apparatus is a pump which does not generate any pulsation. Since the liquid can be fed to the ink jet head while maintaining the state of a constant flow rate, a cooling ability can be kept constant and the temperature of the ink jet head can be controlled at excellent accuracy.

According to still another aspect of the present invention, since the set temperature of the liquid controlled by the temperature controlling means is substantially equal to the environment temperature at which the ink jet printing apparatus is arranged, the liquid of which temperature is controlled to a desired temperature by the temperature controlling means can be fed to the ink jet head at the substantially desired temperature, and the temperature of the ink jet head can be controlled at excellent accuracy. Consequently, the ink jet head having excellent accuracy exhibit a substantially constant discharging quantity and can provide printed images without any fluctuation of density, whereby, for example, a textile printed article having high quality and a processed product such as clothes or the like having the textile printed article used therefor can be obtained.

In addition, according to another aspect of the present invention, vibration generated due to the bending of a liquid recirculating passage for the printing head can be reduced as the carriage is reciprocably displaced at the time of printing operation performed by the ink jet printing apparatus. Even when such vibration is generated, it is absorbed and removed in the auxiliary carriage without transmission of the vibration to the main carriage on which the printing head is mounted. Thus, ink can stably be ejected at all times.

Additionally, according to a still further aspect of the present invention, since a tray having manifolds and/or sub-tubes fixedly mounted thereon is simultaneously drawn while following the movement of the main carriage side having the printing head mounted thereon when the main carriage and the auxiliary carriage are parted away from each other, maintenance and inspection of the main carriage and the auxiliary carriage or the whole printing apparatus and/or replacement of the printing head can easily be carried out. Further, according to another aspect of the present invention, since not only the allowable range of a diameter, rigidity or the like of the main tube extending to the manifold can be expanded but also the sub-tubes between the manifold and the printing heads can be set to a length of necessary smallest limit, recirculation efficiency can be improved while flow resistance in the recirculating passage is reduced. Additionally, the printing apparatus of the present invention can practically be applied irrespective of the number of printing heads, the kind and the number of pipe passages and the kind of liquid.

DETAILED DESCRIPTION OF THE PREFERRED EMBODIMENTS

Now, the present invention will be described in detail hereinafter with reference to the accompanying drawings.

Figure 1:
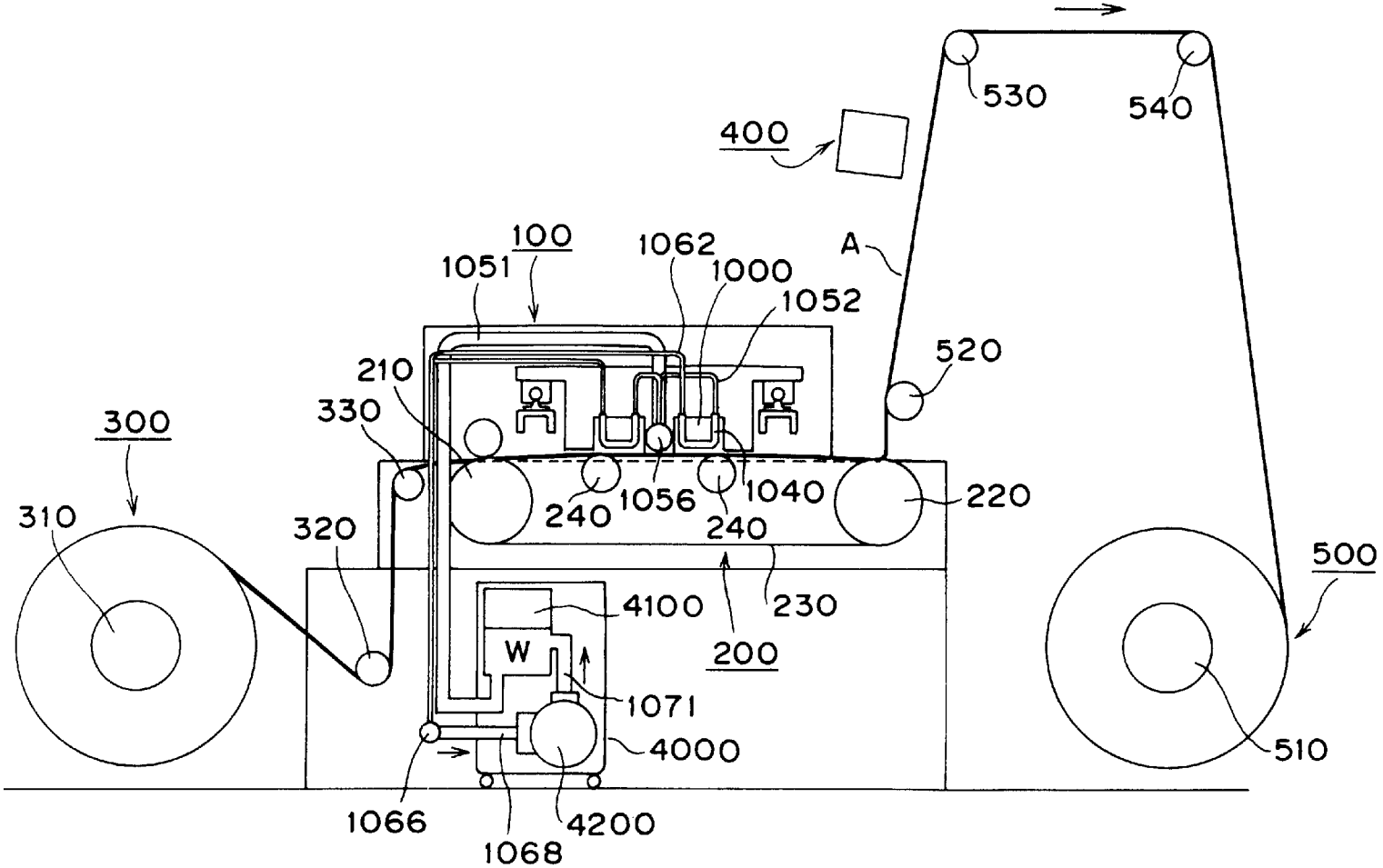
FIG. 1 is a side view showing the schematic structure of an ink jet printing apparatus in accordance with an embodiment of the present invention.
Figure 2:
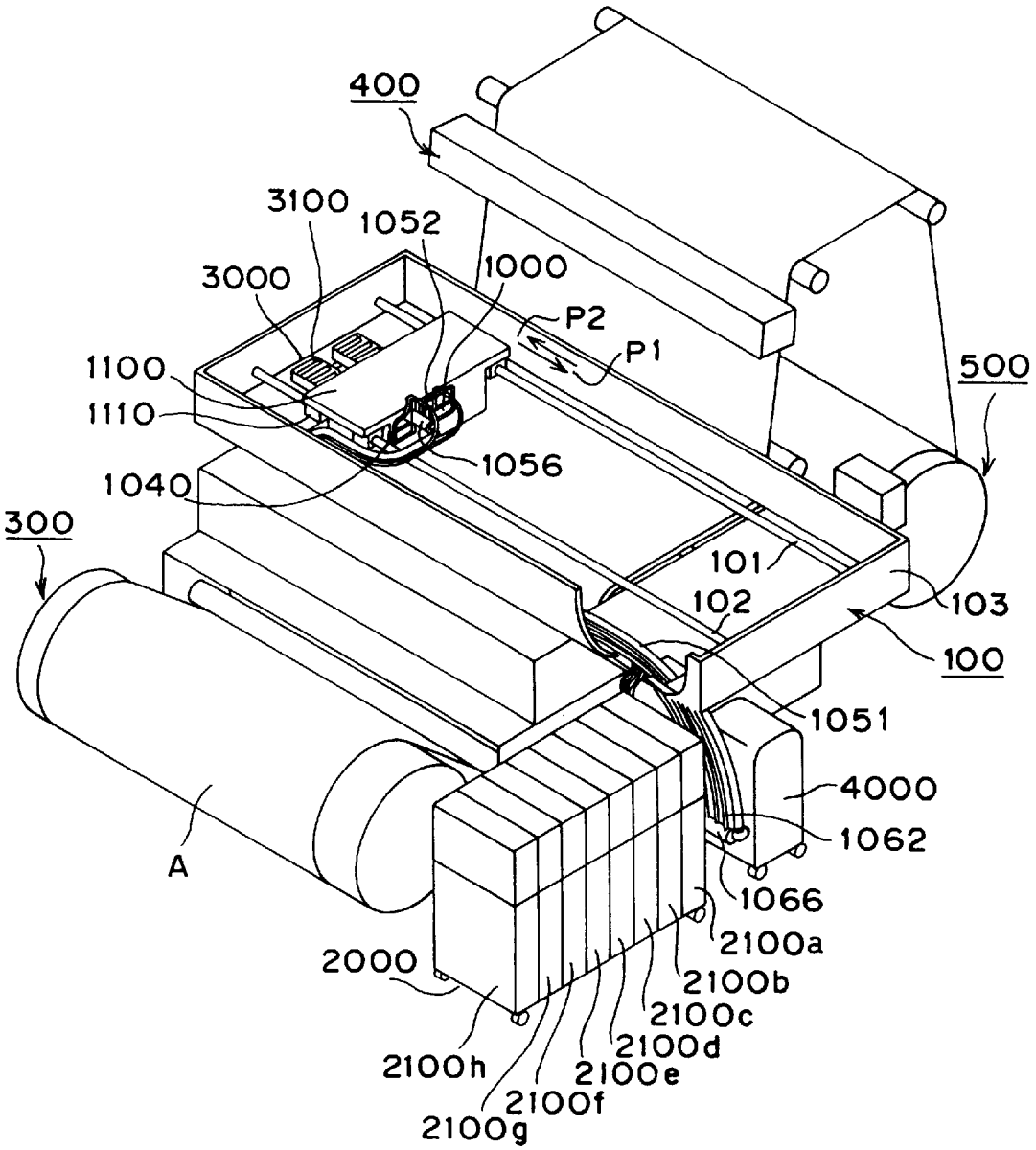
FIG. 2 is a perspective view of the ink jet printing apparatus shown in FIG. 1.

FIG. 1 and FIG. 2 show an ink jet printing apparatus constructed in accordance with an embodiment of the present invention. In detail, FIG. 1 is a sectional view showing main portions of the ink jet printing apparatus, and FIG. 2 is a perspective view showing main portions of the ink jet printing apparatus.

The ink jet printing apparatus shown in FIG. 1 and FIG. 2 is mainly composed of a printer section 100 for printing images or the like on a printing medium A, a conveying section 200 for intermittently conveying the printing medium A by a predetermined quantity (printing length L), an unwinding section 300 for unwinding the printing medium A continuously wound in the form of a roll, a drying section 400 for drying the printing medium A until it can be wound after completion of the printing operation, and a winding section 500 for winding the printing medium A after completion of the drying operation.

The printing medium A is unwound as an unwinding roller 310 is rotated, and thereafter, it is conveyed in the horizontal direction via intermediate rollers 320 and 330 by the conveying section 200 disposed opposite to the printer section 100.

The conveying section 200 includes a conveying roller 210 disposed on the conveyance passage for the printing medium A on the upstream side of the printer section 100 and a belt driving roller 220 disposed on the downstream side of the printer section 100, and it is constructed such that an endless belt 230 is circulatively wound between both the rollers 210 and 220 and extension of the conveying belt 230 is flatly restricted within the range where the printing medium A serves as a printing surface, so as to allow the printing medium to be expanded with an adequate intensity of tension. An adhesive layer is arranged on the outer peripheral surface of the conveying belt 230, and the conveying belt 230 is conveyed while the printing medium A is adhesively attached to the conveying medium A so that the latter is conducted to the position located opposite to the printer section 100 where a printing operation is performed by the printer section 100. Thereafter, the printing medium A is peeled off from the conveying belt 230 by a feeding roller 520, it is dried at the drying section 400 including a heater and so forth, and it is wound by a winding roller 510 via intermediate rollers 530 and 540.

Referring to FIG. 2, a pair of parallel scanning rails 101 and 102 are disposed on a frame 103 of the printer section 100 in the main scanning direction which is different from the conveying direction of the printing medium A, for example, perpendicular to the conveying direction, and a head carriage 1100 having a plurality of printing heads 1000 mounted thereon is slidably supported on the scanning rails 101 and 102 via ball bearings 1110.

It should be noted that the head carriage 1100 is driven by a driving motor (not shown) immovably attached to the frame 103 of the printer section 100 via a driving belt (not shown). The head carriage 1100 is reciprocably displaced on the scanning rails 101 and 102 in the directions identified by arrows P1 and P2 so that printing operations are repeatedly performed for the continuous printing medium A by printing heads 1000 within the range represented by (printing operation per one scanning)=(predetermined printing length L)×(width W of the printing medium A).

The printing heads 1000 are arranged such that two rows of printing heads as seen in the direction perpendicular to the main scanning direction, i.e., in the conveying direction of the printing medium and a plurality of printing heads per one row corresponding to each color are used in order to perform a printing operation, while 50% of image data are distributed to first row printing heads on the upstream side of the conveying passage and 50% of image data are distributed to second row printing heads on the downstream side of the same to print whole image data. In other words, 50% of image data are printed by the printing heads 1000 on the upstream side, and then, when the printing medium A is intermittently displaced, 50% of remaining image data are printed by the printing heads 1000 on the downstream side so that the printed images formed by the printing heads 1000 on the upstream side and the printing heads 1000 on the downstream side overlap each other.

Figure 3:
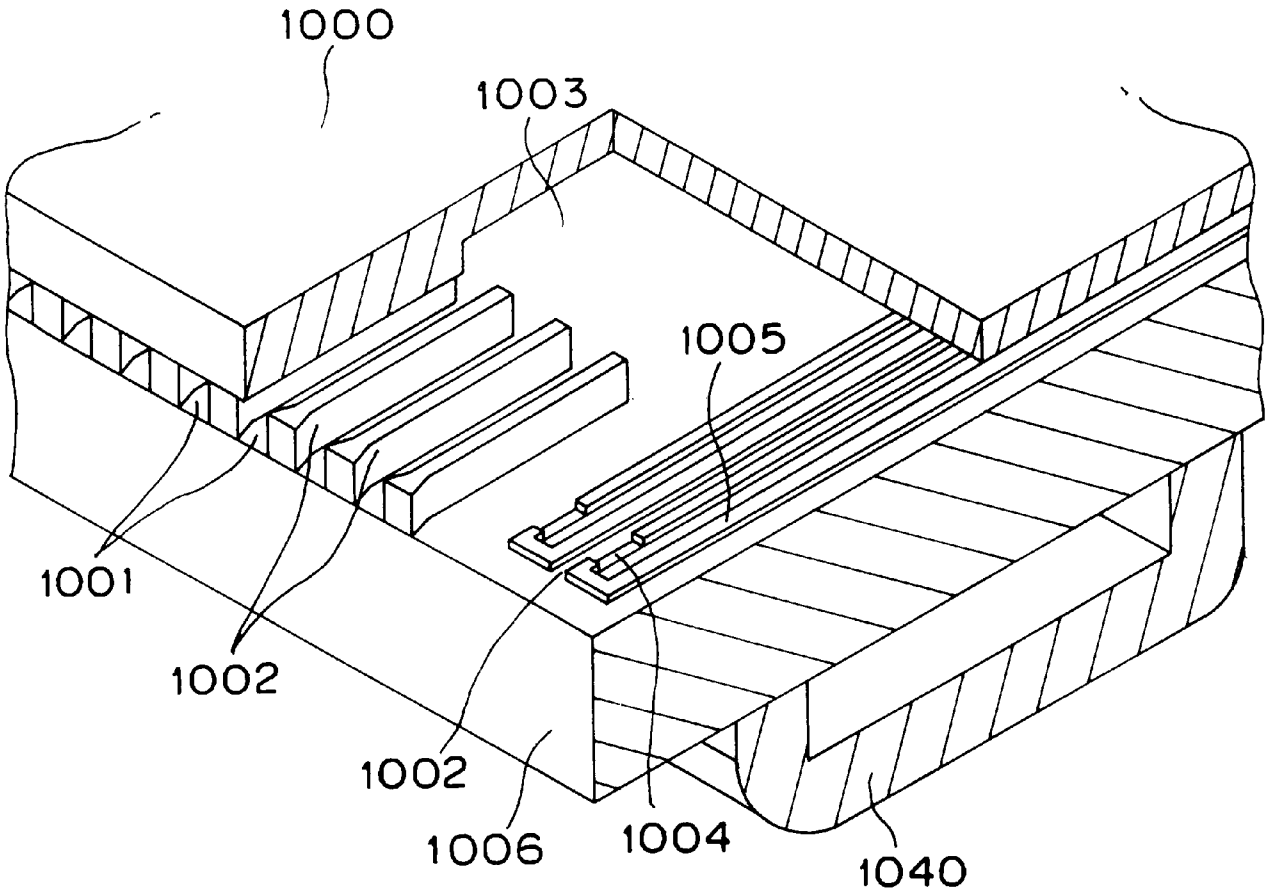
FIG. 3 is a perspective view showing the inner structure of a printing head used for the ink jet printing apparatus.

FIG. 3 is a perspective view which shows the inner structure of a printing head 1000 and a water pipe 1040 attached to the printing head 1000 to serve as a liquid passage. The printing head 1000 includes on a base plate 1006 a plurality of fine ink ejecting ports 1001, a plurality of ink passages 1002 communicated with the ink ejecting ports 1001, a common liquid chamber 1003 for temporarily accumulating ink to be fed to the ink passages 1002, electrothermal transducing elements 1004 formed at part of the ink passages 1002, and electrode wirings 1005 for feeding electricity to the electrothermal transducing elements 1004.

A number of ink ejecting ports 1001 can be arranged at a high density with such a type of printing head that gas bubbles are generated in ink in the ink passage 1002 by utilizing thermal energy as mentioned above and ink droplets are ejected from the ink ejecting ports 1001 as the gas bubbles grow. For this reason, the foregoing type of printing head is suitably employable for performing a printing operation with high resolution. In addition, this type of printing head has another advantages that each printing head can easily be designed with smaller dimensions, advance of the technology in the recent semiconductor field and advantage of the IC technology and the micromachining technology exhibiting remarkable improvement can sufficiently be utilized, it is easy that printing heads can practically be mounted at a high density, and they can be produced at a reduced cost.

Ink feeding passages for feeding inks each having different color and density from an ink feeding device 2000 (see FIG. 2) to the common liquid chamber 1003 are connected to the respective printing heads Water pipe 1040 for recirculating cooling liquid for the purpose of controlling the printing head 1000 to a suitable temperature so as to attain excellent ink ejecting state is attached to the rear surface of the base plate 1006 in such a manner that the cooling liquid comes in direct contact with the rear surface of the base plate 1006.

As shown in FIG. 2, the ink feeding device 2000 includes eight ink tanks 2100*a* to 2100*h* in total corresponding to the ink colors to be used for this embodiment so that inks are fed to the corresponding printing heads 1000 by driving feeding pumps (not shown) arranged for the respective ink tanks via ink feeding tubes extending to the interior of the printer section 100. In this ink feeding, ink is fed by utilizing the capillary phenomenon during the printing operation in response to ejection of ink from the printing head 1000.

It should be noted that ink having same color but exhibiting substantially different color, for example, like dense ink and light ink is accumulated as different ink in respective ink tanks.

As mentioned above, in this embodiment, two printing heads are assigned to ink which exhibit a certain color. Therefore, sixteen printing heads represented by eight colors multiplied by two (here, it is assumed that ink having different density is treated as different ink) are mounted on the head carriage 1100. Namely, ink exhibiting same color is fed to the printing heads 1000 located on the upstream side and the printing heads 1000 correspondingly located on the downstream side.

A covering section 3000 is intended to perform a covering operation or the like for assuring that the printing head 1000 attains reliable ejection stability, and it includes a capping portion 3100 for covering an ejecting port forming surface of the printing head 1000 to prevent viscosity of the ink from increasing, a wiping portion (not shown) for wiping ink droplets or the like adhering onto the ejecting port forming surface of the printing head 1000, a preliminary ejecting portion (not shown) for receiving the ejection of ink for removing the ink having increased viscosity developed in the printing head 1000, a detergent liquid tank (not shown) for feeding detergent liquid, a pump portion (not shown) for sucking and ejecting the waste liquid of the detergent liquid, and a discharging portion (not shown) for receiving and discharging the waste liquid of the detergent liquid ejected from the pump portion.

A cooling liquid recirculating device 4000 shown in FIG. 1 is a device which is operated such that cooling liquid W such as water or the like received in a cooling liquid accumulating tank 4100 is controlled to assume a desired temperature, it is fed to a water pipe 1040 attached to the printing head 1000 by driving a cooling liquid feeding pump 4200, and it is again recirculated to the cooling liquid accumulating tank 4100.

Hereinafter, an embodiment of this cooling liquid recirculating device 4000 will be described below with reference to FIG. 1, FIG. 2 and FIG. 4.

In this embodiment, it is assumed that a room temperature is 25° C. and a set temperature T of the cooling liquid W is 25±0.5° C.

A cooler 4110, a heater 4120 and a temperature sensor 4130 are arranged in the cooling liquid accumulating tank 4100, and the cooler 4110 is constructed such that a coolant such as HFC-134a or the like is recirculated to the cooler 4110 via a compressor 4112 disposed outside of the cooling liquid accumulating tank 4100, a condenser 4114 and capillary tubes. A predetermined quantity of cooling liquid W is accumulated in the cooling liquid accumulating tank 4100.

A connection port is formed on the bottom of the cooling liquid accumulating tank 4100, and this connection port is connected to a forward passage manifold 1056 via a forward passage main tube 1051 such as a spring hose or the like which has bending properties and does not collapse under the influence of negative pressure. Sixteen forward passage sub-tubes 1052 are connected to the forward passage manifold 1056, and each of them is connected to the inlet side of the water pipe 1040 on the printing head 1000. A first connecting passage is constructed by the forward passage main tube 1051, the forward manifold 1056 and the forward passage sub-tubes 1052 as mentioned above.

Respective backward passage sub-tubes 1062 are connected to the outlet side of sixteen water pipes 1040, and these backward passage sub-tubes 1062 are connected to a backward passage manifold 1066. In addition, the backward passage manifold 1066 is connected via a backward passage main tube 1068 to the suction side of a cooling liquid feeding pump 4200 such as a peripheral pump which does not generate any pulsation. Thus, a second connecting passage is constructed by the backward passage sub-tubes 1062, the backward passage manifold 1066 and the backward passage main tube 1068 as mentioned above.

The outlet port of the cooling liquid feeding pump 4200 is connected to a connection port formed on the side of the cooling liquid accumulating tank 4100 via a feeding tube 1071, and a third connecting passage is constructed by the feeding tube 1071.

Figure 4:
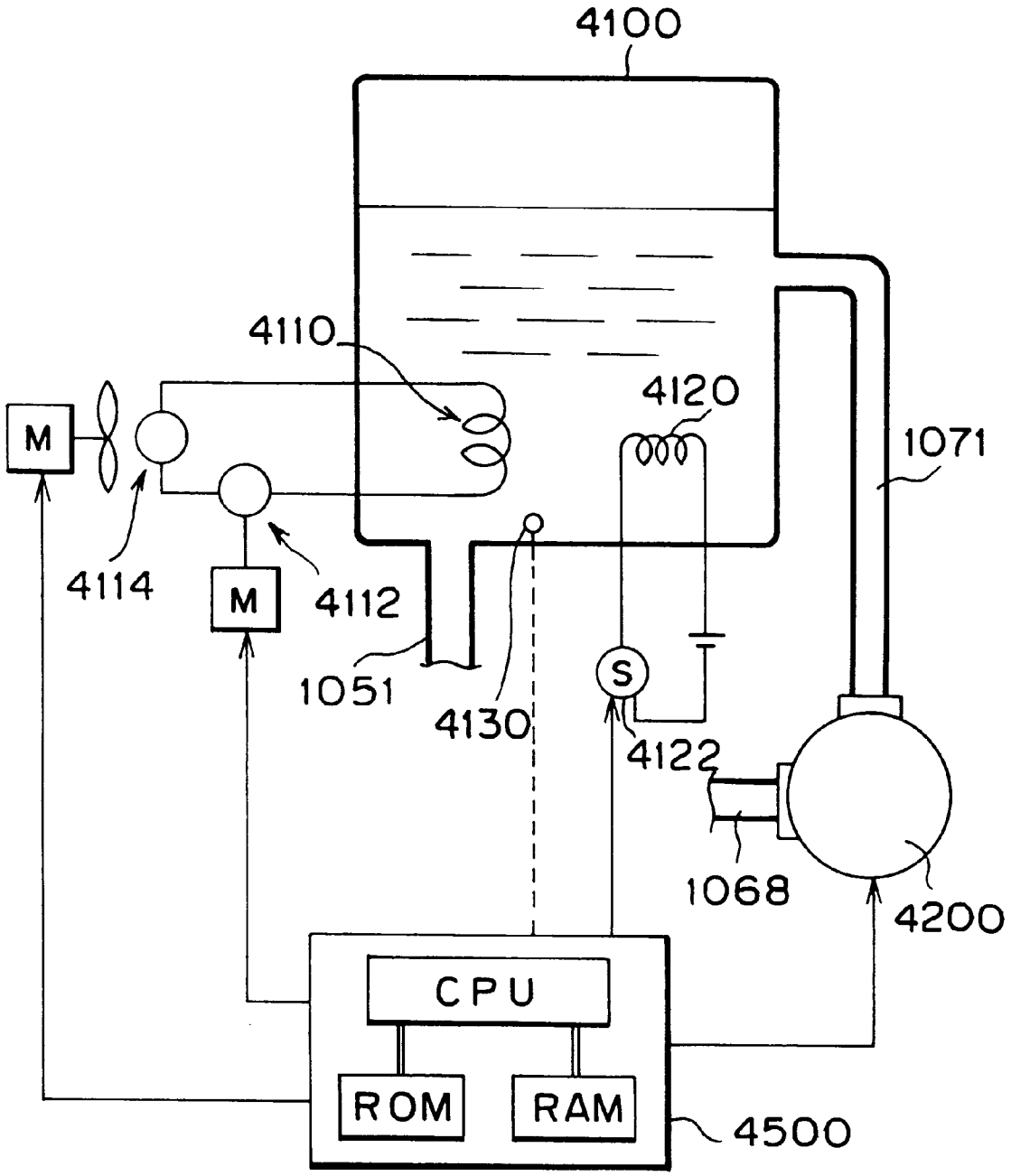
FIG. 4 is a block diagram showing the temperature controlling system in the ink jet printing apparatus.
Figure 5:
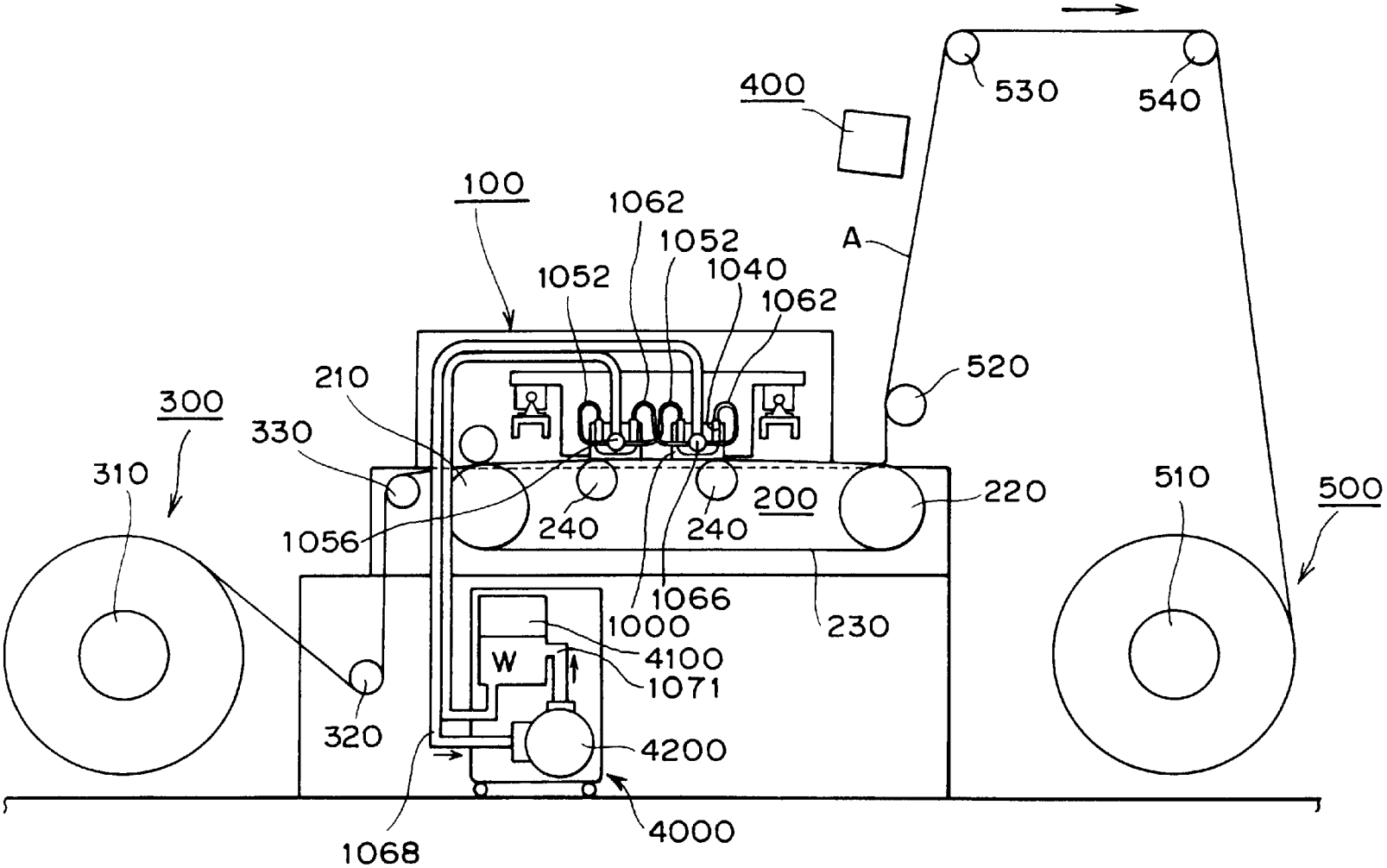
FIG. 5 is a side view showing the schematic structure of an ink jet printing apparatus constructed in accordance with another embodiment of the present invention.

Incidentally, in FIG. 4, reference numeral 4500 denotes a controller which serves to control the temperature of the ink jet printing apparatus of the present invention. The controller 4500 is constructed by a microcomputer and so forth.

When CPU in the controller 4500 receives a signal which indicates the start of a cooling operation, the CPU detects the temperature of the cooling liquid W with the aid of temperature sensor 4130. If it is found that the temperature of the cooling liquid W is lower than a lower limit of 24.5° C. of the set temperature, a heater driving circuit is activated such that a switch 4122 is turned on to drive the heater 4120. When the temperature of the cooling liquid W reach the lower limit of 24.5° C. of the set temperature, the driving of the heater 4120 is stopped. Additionally, if it is found that the temperature of the cooling liquid W is higher than the lower limit of 24.5° C. of the set temperature, the heater driving circuit does not drive the heater 4120.

When the temperature of the cooling liquid W is higher than an upper limit of 25.5° C. of the set temperature, this is informed to the CPU by the temperature sensor 4130 so that the compressor 4112 and a cooling fan for the condenser 4114 are operated. The vaporized HFC-134a is compressed by the compressor 4112 to assume high temperature and high pressure, and it is fed in the coolant passage. The vaporized coolant HFC-134a compressed to assume high temperature and high pressure has a high boiling point and is liable to liquidize so that it is forcibly cooled in the condenser 4114 by rotating a cooling fan, causing it to be liquidized. The pressure of the liquidized coolant HFC-134a is reduced at the capillary tube, and then, the coolant is fed to the cooler 4110. Since the liquidized coolant HFC-134a fed to the cooler 4110 has low pressure, it has a low boiling point and is liable to vaporize so that it takes heat from the cooling liquid W which is in contact with the cooler 4110, causing it to be vaporized again and flow back to the compressor 4112. As heat is taken from the cooling liquid W by the recirculation of the coolant in that way, the temperature of the cooling liquid W is lowered.

When the temperature of the cooling liquid W is lowered from the upper limit of 25.5° C. of the set temperature, this is detected by the CPU via the temperature sensor 4130 so that operation of the compressor 4112 is stopped, causing the feeding of the coolant to be interrupted. The cooling fan for the condenser 4114 is also stopped. At this time, the coolant in the cooler 4110 is still vaporized and no heat is taken from the cooling liquid W being in contact with the cooler 4110. Consequently, the temperature of the cooling liquid W is not lowered. The temperature controlling as mentioned above is repeated during the cooling operation.

When the controller 4500 sends a signal which instructs the starting of an operation of the cooling liquid feeding pump 4200, the cooling liquid feeding pump 4200 starts its operation, causing suction of the cooling liquid W in the backward passage main tube 1068 to be started. Then, the pressure in the backward passage manifold 1066, the backward passage sub-tubes 1052 and the water pipe 1040 is successively lowered to assume negative pressure, and the cooling liquid W accumulated in the cooling liquid accumulating tank 4100 with the set temperature T is fed to the water pipe 1040 on the printing head 1000 via the forward passage main tube 1051, the forward passage manifold 1056 and the forward passage sub-tubes 1052 so that temperature controlling for the printing head 1000 is performed Since the set temperature T is 25° C. and the room temperature is also 25° C. as mentioned above, no heat is transferred when the cooling liquid W passes through the forward passage main tube 1051, the forward passage manifold 1056 and the forward passage sub-tubes 1052 so that the cooling liquid W having the set temperature T can be fed to the water pipe 1040.

Further, since the cooling liquid W having substantially set temperature can be fed to the printing head 1000 by equalizing or substantially equalizing the set temperature of the cooling liquid W to the room temperature, the temperature of the printing head 1000 can be controlled at excellent accuracy.

Incidentally, a quantity of heat to be transferred between the cooling liquid W and the interior of the room is increased as the difference between the set temperature and the room temperature is enlarged more and more, and the cooling liquid W having temperature different from the set temperature T is fed to the water pipe 1040, causing the temperature controlling of the printing head 1000 to a desired temperature to become difficult. Controlling of the difference between the environment temperature and the set temperature within the range of 5° C. or less is not difficult so far when the accuracy of temperature controlling of the environment temperature and the accuracy of temperature controlling of the cooling liquid to the set temperature are taken into consideration. Rather, the foregoing controlling is sufficiently practical and preferably acceptable.

In addition, since the cooling liquid feeding pump 4200 is a pump such as a peripheral or a swirl flow pump or the like which does not generate any pulsation, the flow rate of the cooling liquid W passing through the water pipe 1040 is always constant. Additionally, since the temperature of the cooling liquid W is controlled to the set temperature T as mentioned above, the cooling ability for cooling the printing head 1000 becomes constant with the result that the temperature of the printing head 1000 can be controlled at excellent accuracy.

As heat is taken from the printing head 1000, the temperature of the cooling liquid W fed to the water pipe 1040 becomes T+δTh, and the cooling liquid W enters in the suction port of the cooling liquid feeding pump 4200 via the backward passage sub-tubes 1062, the backward passage manifold 1066 and the backward passage main tube 1068. The temperature of the cooling liquid W which has entered in the cooling liquid feeding pump 4200 with the temperature T+δTh is further elevated due to heat generation of the cooling liquid feeding pump 4200 to assume temperature T+δTh+δtp so that the cooling liquid W is discharged from the discharge port of the cooling liquid feeding pump 4200 to the side of the cooling liquid accumulating tank 4100. Then, such operations that the temperature of the cooling liquid W is controlled to the set temperature T by performing the temperature controlling in the aforementioned manner and the cooling liquid W is again sucked in the forward passage main tube 1051 by the cooling liquid feeding pump 4200 are repeated. In this manner, the cooling liquid W of which temperature is controlled to the set temperature T can be fed to the water pipe 1040 by arranging the water pipe 1040 at the intermediate part of the passage for sucking the cooling liquid W in the cooling liquid feeding pump 4200. Consequently, the temperature of the printing head 1000 can be controlled at excellent accuracy.

Since the pressure of the cooling liquid W flowing through the forward passage main tube 1051, the forward passage manifold 1056, the forward passage sub-tubes 1052, the water pipe 1040, the backward passage sub-tubes 1062, the backward passage manifold 1066 and the backward passage main tube 1068 is negative pressure, any leakage of the cooling liquid W does not arise at any one of the cooling liquid passages or at their connecting portions or the like due to deterioration of the material induced as time elapses or occurrence of unexpected trouble. Thus, contamination of printed images due to adhesion of the cooling liquid W to the printing medium A located directly below the cooling liquid passages can be prevented.

Next, another preferred embodiment of an ink jet printing apparatus constructed in accordance with the present invention will be described below with reference to FIG. 5 to FIG. 8. Unless otherwise specified, repeated description of components each having the same function to that in the preceding embodiment will be eliminated. Accordingly, the same reference members are used in FIGS. 5–8 for parts that are the same or similar to parts shown in FIGS. 1–4.

Figure 6:
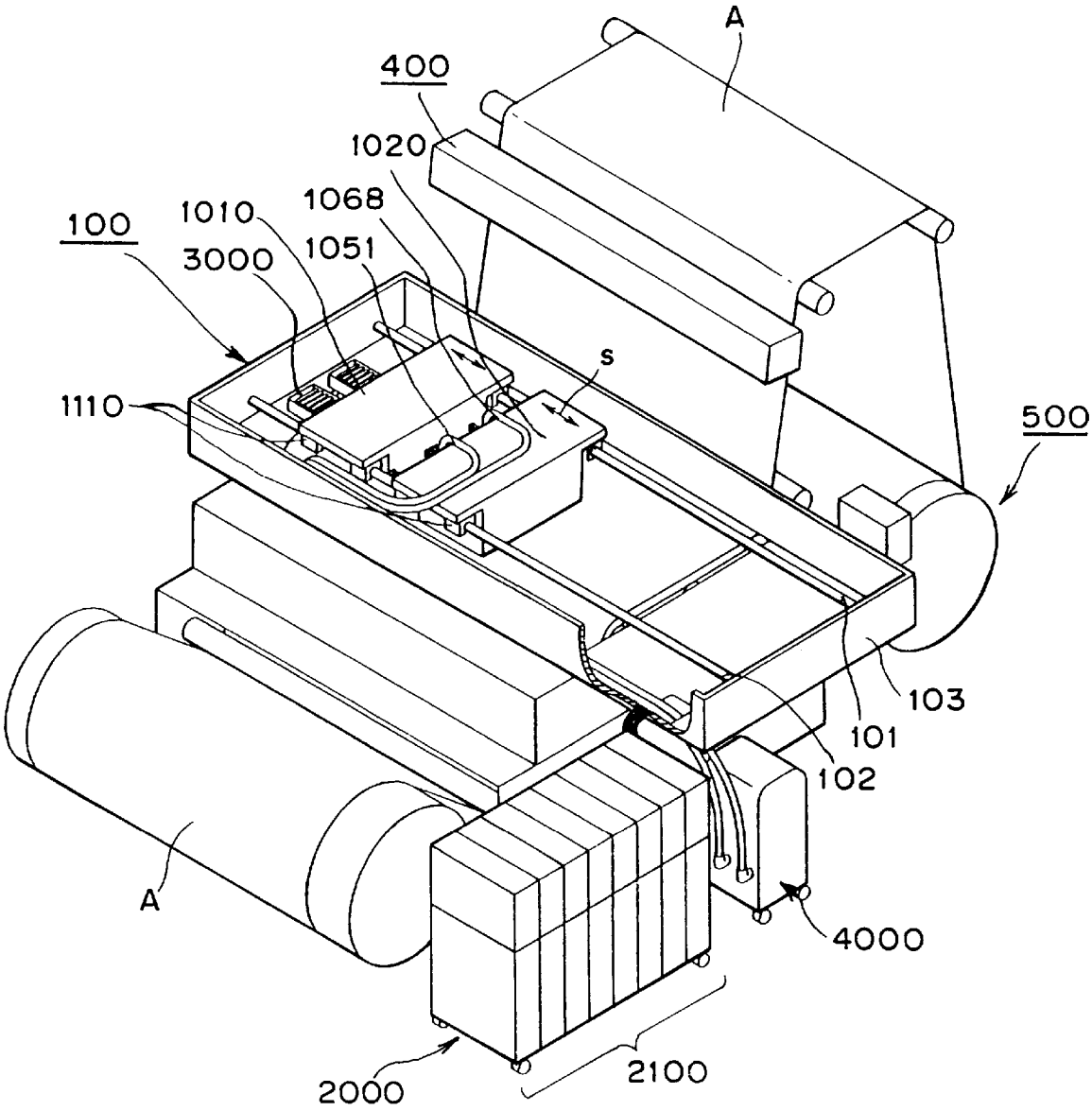
FIG. 6 is a perspective view showing the ink jet printing apparatus shown in FIG. 5.

In this embodiment, as shown in FIG. 6, a pair of parallel guide rails 101 and 102 extending in the main scanning directions S intersecting at a right angle relative to the conveying direction of a printing medium A are disposed in a frame 103 of a printer section 100 in the same manner as the preceding embodiment, and a main carriage 1010 and an auxiliary carriage 1020 are slidably disposed on the guide rails 101 and 102 via ball bearings 1110. Both the main carriage 1010 and the auxiliary carriage 1020 are constructed so as to reciprocably move in the main scanning directions S in synchronization with each other. It should be not limited that the main carriage 1010 and the auxiliary carriage 1020 are reciprocably displaced in synchronization with each other but, of course, they may separately reciprocably be displaced. In this embodiment, the ink jet printing apparatus is constructed such that both the carriages are driven in synchronization with each other via driving belts (not shown) by driving motors (not shown) attached to one of the side walls of the frame 103.

In addition, a plurality of printing heads 1000 for forming images on a fabric A are disposed on the lower surface in the main carriage 1010 so that a color printing operation can be performed while the main carriage 1010 is reciprocably displaced in the main scanning directions S. Further, ink feeding passages for feeding inks each having different color and density from an ink feeding device 2000 to a common liquid chamber of each printing head 1000 and a water pipe

1040 for causing cooling liquid to flow for the purpose of controlling the printing heads 1100 to an adequate temperature so as to attain an excellent ink ejection state are attached to the printing head 1000.

A forward passage manifold 1056 for distributing the cooling liquid to the inlet port side of the water pipes 1040 on the plurality of printing heads 1000 and a backward passage manifold 1066 for recovering the cooling liquid from the outlet port side of the water pipe 1040 are arranged between the water pipes 1040 attached to the printing head 1000 and a cooling liquid recirculating device 4000. In this embodiment, the forward passage manifold 1056 and the backward passage manifold 1066 are arranged on the lower surface in the auxiliary carriage 1020.

Figure 7:
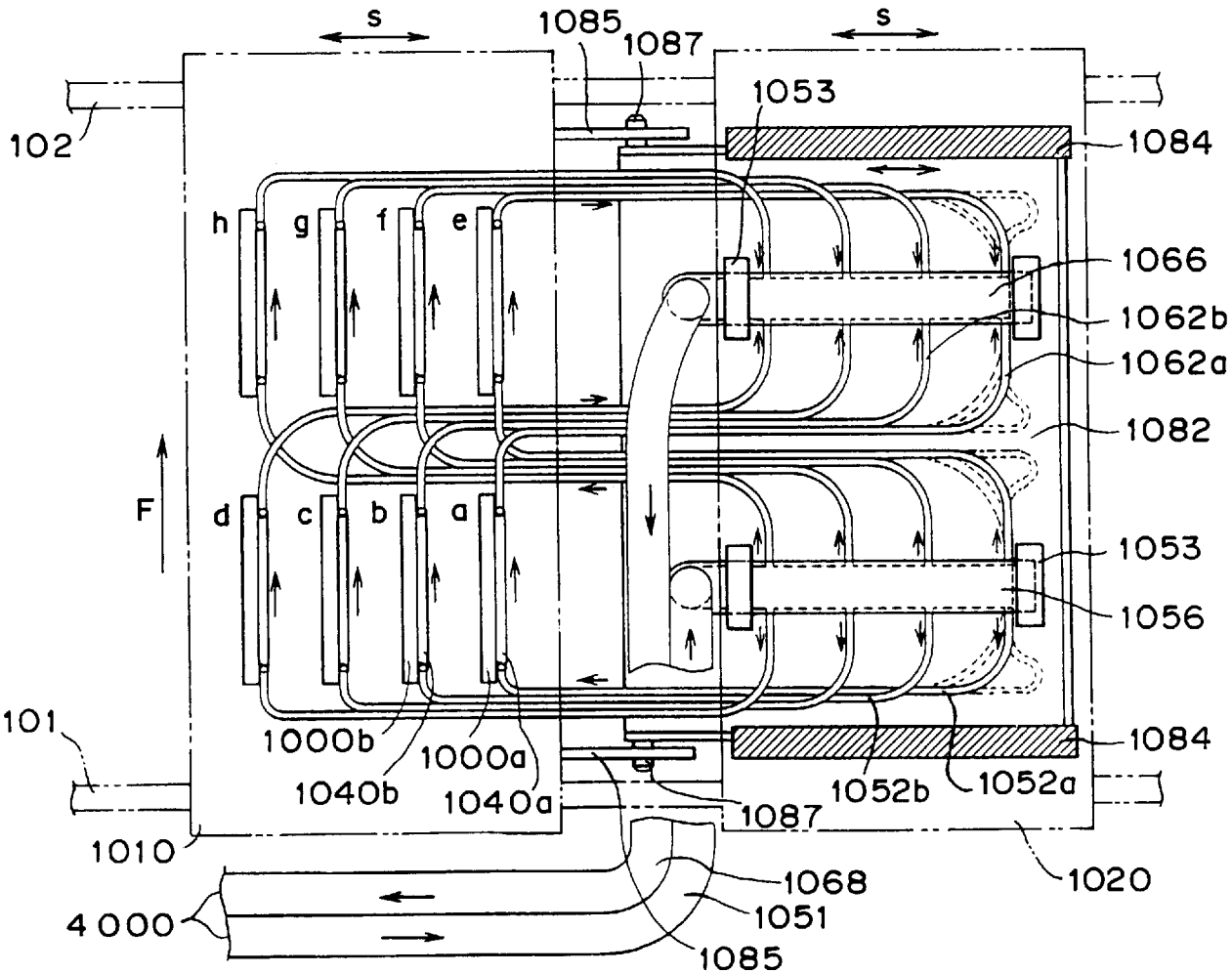
FIG. 7 is a plan view showing a main carriage and an auxiliary carriage in a first embodiment of the ink jet printing apparatus shown in FIG. 5.
Figure 8:
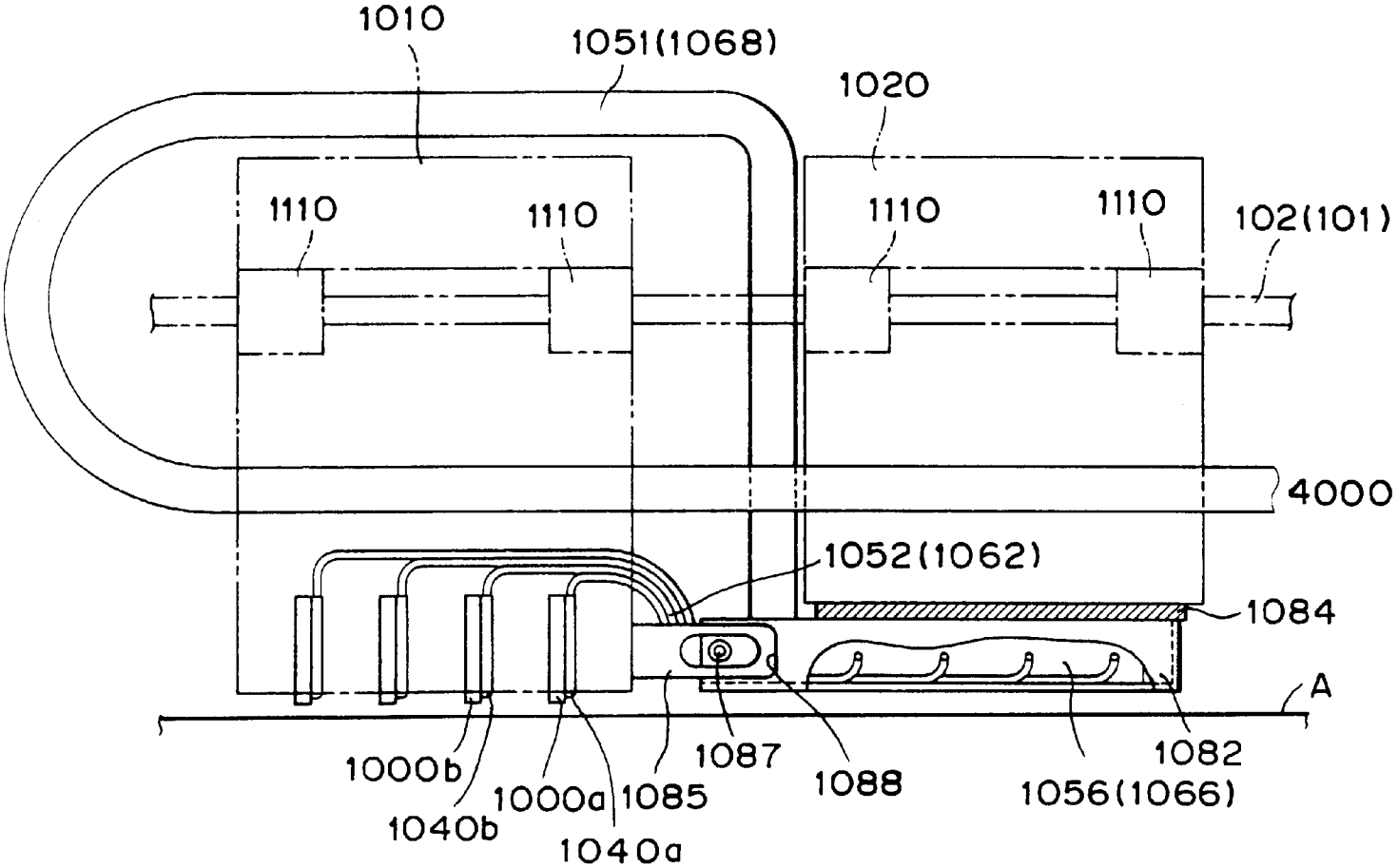
FIG. 8 is a partially sectioned side view of the ink jet printing apparatus shown in FIG. 7.

FIG. 7 and FIG. 8 show a first example of this embodiment of the present invention, and the printing head 1000 having a plurality of ink ejecting ports arranged in a predetermined direction (in the conveying direction F in this example) is disposed on the shown main carriage 1010 at a right angle relative to the main scanning directions S. In this example, to assure that a color printing operation can be performed, a plurality of printing heads corresponding to inks each having different color are disposed in the main scanning direction S in accordance with the order of 1000*a*, 1000*b* - - - . In addition, the fact that printing heads 1000 are arranged in two stages at a right angle relative to the main scanning direction S consists in that a high speed printing operation can be performed while the printing range of the printing head 1000 at each stage is assigned by the printing head 1000 as mentioned above.

In the cooling liquid recirculating device 4000 constructed in the aforementioned manner, the cooling liquid W having its temperature controlled to a predetermined one is delivered to the forward passage manifold 1056 from a cooling liquid accumulating tank 4100 via a forward passage main tube 1051, and then, it is delivered from the forward passage manifold 1056 to water pipes 1040*a*, 1040*b* - - - via forward passage sub-tubes 1052*a*, 1052*b* - - - connected to one end of each of the water pipes 1040 attached to the respective printing heads 1000. In this manner, printing heads 1000*a* and 1000*b* contiguous to water pipes 1040*a* and 1040*b* are effectively cooled. After the printing heads 1000*a* and 1000*b* are cooled, the cooling liquid W is delivered from other ends of the water pipes 1040*a*, 1040*b* - - - to a backward passage manifold 1066 via backward passage sub-tubes 1062*a* and 1062*b* and collected therein, subsequently, it is returned from the backward passage manifold 1066 to a cooling liquid feeding pump 4200 of the cooling liquid recirculating device 4000 via a backward passage main tube 1068. Here, it is desirable that a piping having a possibly large inner diameter sectional area is employed for the forward passage main tube 1051 and the backward passage main tube 1068 in order to reduce the flow passage resistance in the recirculating passage. In addition, it is necessary that the forward passage main tube 1051 and the backward passage main tube 1068 are made of a piping material having rigidity to some extent, for example, like a spring hose which does not collapse under the influence of negative pressure.

On the other hand, it is desirable that a small diameter pipe material, for example, a pipe material having excellent bending properties like a urethane tube is employed for the forward passage sub-tubes 1052*a*, 1052*b* - - - and backward passage sub-tubes 1062*a*, 1062*b* - - - for connecting the forward passage manifold 1056 and the backward passage manifold 1066 to the water pipes 1040*a*, 1040*b* - - - , respectively. Therefore, since vibration of the forward passage sub-tube 1052 and the backward passage sub-tube 1062 is absorbed in the bent portion thereof even when the auxiliary carriage 1020 is vibrated for the reason of bending of the forward passage main tube 1051 and the backward passage main tube 1068 caused by displacement of the auxiliary carriage 1020 in the main scanning directions S, any vibration is not transmitted to the main carriage 1010 so that the printing head 1000 is not adversely affected at all. Consequently, excellent ink ejection can be carried out.

The forward passage manifold 1056 and the backward passage manifold 1066 are immovably held on a tray 1082 by clamping members 1053, respectively. A pair of slide rails 1084 each including a locking mechanism are disposed at the opposite ends of the tray 1082. One end of each of the slide rails 1084 is immovably fixed to the bottom of the auxiliary carriage 1020. Normally, the slide rails 1084 are immovably fixed to constant positions at the lower part of the auxiliary carriage 1020 (to assume the state shown in FIG. 7 and FIG. 8), and the tray 1082 can relatively be displaced in the main scanning directions S relative to the auxiliary carriage 1020 by unlocking the locking mechanism. This is intended to maintain a sufficient access space between the main carriage 1010 and the auxiliary carriage 1020 when the printing head 1000 is exchanged with another one. In addition, a pair of shafts 1087 are disposed at both the side ends of the tray 1052 in the opposing state, and the shafts 1087 are engaged with elongated holes 1088 formed on a pair of guide members 1085 disposed on the main carriage 1010. Normally, the shafts 1087 and the elongated holes 1088 are arranged so as not to come in contact with each other as shown in FIG. 8, whereby vibration of the auxiliary carriage 1020 is not transmitted directly to the main carriage 1010 via the guide members 1085. In addition, since the shafts 1087 disposed on the tray 1082 are pulled by the guide members 1085 when the main carriage 1010 and the auxiliary carriage 1020 are parted away from each other, the tray 1082 can simultaneously be drawn while it follows the movement of the main carriage 1010.

Figure 9:
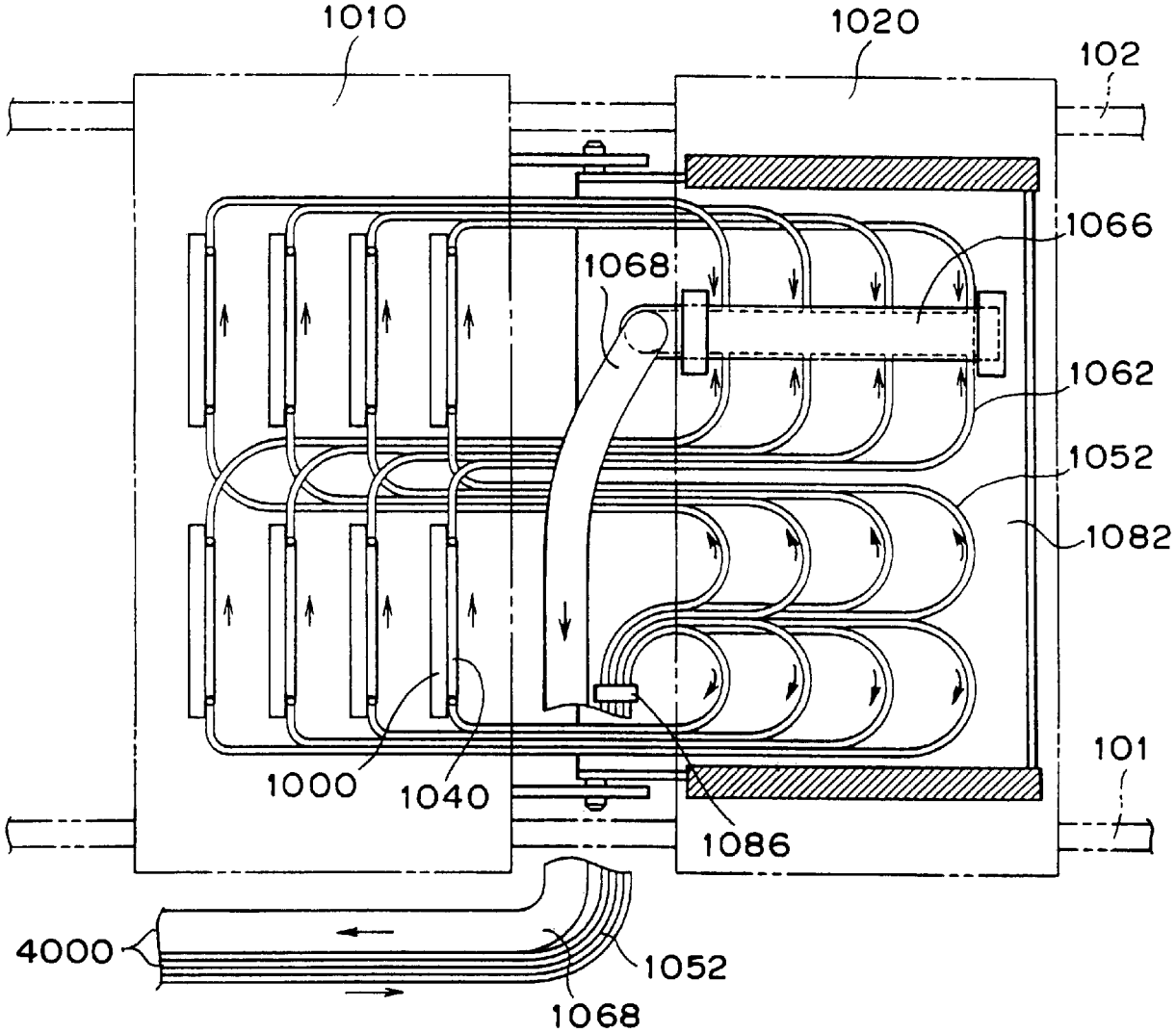
FIG. 9 is a plan view showing a main carriage and an auxiliary carriage in a second embodiment of the ink jet printing apparatus shown in FIG. 5.

A second example of the another embodiment of the ink jet printing apparatus constructed according to the present invention is shown in FIG. 9. As shown in the drawing, the structure of this second example other than that shown below is the same as the structure of the first example precedently described above. In the second example, a backward passage manifold 1066 is disposed only on one side of the recirculating passage, i.e., only on the backward passage side. In the recirculating passage on the other forward passage side, a forward passage manifold 1056 is disposed at a predetermined position other than the auxiliary carriage 1020, and this forward passage manifold 1056 and respective water pipes 1040 are directly connected to each other via a plurality of forward passage sub-tubes 1052. Here, the forward passage sub-tubes 1052 are fixed to a lower tray 1082 by a clamping member 1086 at the intermediate part thereof. Therefore, even when vibration is generated due to bending of the forward passage sub-tubes 1052 and the backward passage main tube 1068 as the auxiliary carriage 1020 is reciprocably displaced, the vibration is effectively absorbed in the same manner as the case of the first example. Thus, transmission of the vibration to the main carriage 1010 side having the printing heads 1000 mounted thereon can be prevented.

Since it is required that the backward passage main tube 1051 and the forward passage main tube 1068 have a large inner diameter and exhibit rigidity, this example is appreciably disadvantageous in respect of bending properties. In the case that reciprocable displacement of the auxiliary carriage 1020 is hindered by a load at the time of bending, the second example is effectively employable as means for achieving reduction of the load. In this case, however, since it is anticipated that the flow passage resistance in the recirculating passage increases by elongating of the flow passage of the recirculating passage having a small inner diameter sectional area, it is necessary that the capacity of the cooling liquid feeding pump 4200 is enlarged in order to assure that the same flow rate as that in the aforementioned first embodiment is obtained.

In the preceding first example, the sub-tubes 1052 and 1062 are arranged at the lower part of the auxiliary carriage 1020 but the arrangement of the sub-tubes should not be limited to the foregoing position, and they may be arranged at either side of the upper and lower sides of the auxiliary carriages 1020. In addition, the printing heads 1000 should not be limited to the structure including four systems and two stages. To assure that a printing operation can be performed with them at a higher accuracy and fineness, they may be arranged in the form of a multi-systems such as 8 systems, 12 systems - - - .

What is claimed is:

1. An ink jet printing apparatus having a liquid flow passage arranged in contact with an ink jet head for a liquid to flow therethrough, comprising:

a liquid accumulating section in which said liquid is accumulated;

a pump including a suction side and a discharge side for feeding said liquid;

a first connecting passage for connecting said liquid accumulating section to an inlet of said liquid flow passage;

a second connecting passage for connecting an outlet of said liquid flow passage to said suction side of said pump; and a third connecting passage for connecting said liquid accumulating section to said discharge side of said pumps, wherein said liquid is a cooling liquid for cooling said ink jet head and said cooling liquid is recirculated in a recirculating passage formed, in turn, by said pump, said third connecting passage, said liquid accumulating section, said first connecting passage, said liquid flow passage, said second connecting passage and said pump.

2. An ink jet printing apparatus as claimed in claim 1, further comprising:

temperature controlling means for controlling the temperature of said liquid accumulated in said liquid accumulating section.

3. An ink jet printing apparatus as claimed in claim 1, wherein said pump is a pump which does not generate any pulsation.

4. An ink jet printing apparatus as claimed in claim 3, wherein said pump is a peripheral pump.

5. An ink jet printing apparatus as claimed in claim 2, wherein a set temperature of said liquid controlled by said temperature controlling means is substantially equal to an operational environment temperature at which said ink jet printing apparatus is arranged.

6. An ink jet printing apparatus as claimed in claim 5, wherein a difference between the set temperature of said liquid controlled by said temperature controlling means and the environment temperature at which said ink jet printing apparatus is arranged is 5° C. or less.

7. An ink jet printing apparatus as claimed in claim 1, wherein said ink jet printing apparatus comprises a carriage capable of mounting a plurality of ink jet heads thereon, said carriage being reciprocably displaceable in a direction different from a conveying direction of a printing medium, said first connecting passage comprises a first main tube for connecting said liquid accumulating section to a first manifold immovably disposed on said carriage and a plurality of first sub-tubes for respectively connecting said first manifold to an inlet portion of a plurality of liquid passages on said ink jet heads, and said second connecting passage comprises a plurality of second sub-tubes for respectively connecting an outlet portion of said plurality of liquid passages on said ink jet heads to a second manifold and a second main tube for connecting said second manifold to the suction side of said pump.

8. An ink jet printing apparatus as claimed in claim 7, wherein at least said first main tube and said second sub-tubes have bending properties.

9. An ink jet printing apparatus as claimed in claim 1, wherein said ink jet head comprises an element for generating thermal energy for generating film boiling in ink as energy to be utilized for ink ejection.

10. An ink jet printing apparatus as claimed in claim 7, wherein said printing medium is a cloth.

11. An ink jet printing apparatus, comprising:

a first carriage for mounting a printing head thereon, a liquid flow passage for through-flow of a cooling liquid to said printing head;

cooling liquid recirculating and feeding means for feeding said cooling liquid by recirculation of said cooling liquid through said liquid flow passage; said cooling liquid recirculating and feeding means comprising:

a pump including a suction side and a discharge side for feeding said cooling liquid, a liquid accumulating section in which said liquid is accumulated, a first connecting passage having at least first and second ends of which the first end is connected to said liquid accumulating section and of which the second end is connected to an inlet of said liquid flow passage, a second connecting passage having at least first and second ends of which the first end is connected to said suction side of said pump and of which the second end is connected to an outlet of said liquid flow passage, and a third connecting passage for connecting said liquid accumulating section to said discharge side of said pump, and a second carriage adapted to be driven in association with said first carriage and holding at least part of said first connecting passage and said second connecting passage, wherein said cooling liquid is recirculated in a recirculating passage formed, in turn, by said pump, said third connecting passage, said liquid accumulating section, said first connecting passage, said liquid flow passage, said second connecting passage and said pump.

12. An ink jet printing apparatus as claimed in claim 11, wherein said second carriage further comprises a tray which is arranged so as to relatively move in the main scanning direction and associated with said first carriage, and at least part of said first connecting passage and said second connecting passage is held on said tray.

13. An ink jet printing apparatus as claimed in claim 11, wherein a plurality of print heads are mounted on said first carriage, and further comprising a corresponding plurality of liquid flow passages for causing cooling liquid to flow while coming in contact with respective ones of the plurality of printing heads.

14. An ink jet printing apparatus as claimed in claim 11, wherein said pump is a pump which does not generate any pulsation.

15. An ink jet printing apparatus as claimed in claim 11, further comprising: temperature controlling means for controlling the temperature of the cooling liquid accumulated in said liquid accumulating section.

16. An ink jet printing apparatus as claimed in claim 13, wherein said first connecting passage comprises a first main tube for connecting said liquid accumulating section to a first manifold immovably fixed to said second carriage and a plurality of first sub-tubes for connecting said first manifold to inlet portions of liquid passages on said plurality of printing heads, and said second connecting passage comprises a plurality of second sub-tubes for connecting outlet portions of a plurality of liquid flow passages on said printing heads to a second manifold immovably fixed to said second carriage and a second main tube for connecting said second manifold to the suction side of said pump.

17. An ink jet printing apparatus as claimed in claim 13, wherein at least said first main tube and said second main tube are tubes each of which does not collapse under the influence of negative pressure and has bending properties.

18. An ink jet printing apparatus as claimed in claim 13, wherein said first connecting passage comprises a plurality of first sub-tubes for connecting said liquid accumulating section to inlet portions of liquid passages on said plurality of printing heads and at least part of which is held on said second carriage, and said second connecting passage comprises a plurality of second sub-tubes for connecting outlet portions of a plurality of liquid passages on said printing heads to a manifold immovably fixed to said second carriage and a main tube for connecting said manifold to the suction side of said pump.

19. An ink jet printing apparatus as claimed in claim 16, wherein at least said first sub-tubes and said second sub-tubes are tubes each of which has flexibility.

20. An ink jet printing apparatus as claimed in claim 16, wherein said second carriage further comprises a tray which is arranged so as to relatively move in the main scanning direction and associated with said first carriage, and said first manifold and said second manifold are immovably fixed to said tray.

* * * * *

UNITED STATES PATENT AND TRADEMARK OFFICE

CERTIFICATE OF CORRECTION

PATENT NO. : 6,174,055 B1
DATED : January 16, 2001
INVENTOR(S) : Sugikubo et al.

It is certified that error appears in the above-identified patent and that said Letters Patent is hereby corrected as shown below:

Column 1,
Line 44, "can not" should read -- cannot --.
Line 48, "is" should read -- be --; and
Line 50, "can not" should read -- cannot --.

Column 2,
Line 14, "can not" should read -- cannot --.

Column 3,
Line 1, "can not" should read -- cannot --.
Line 16, "reciprocably" should read -- reciprocally --; and
Line 26, "has" should read -- have --.

Column 4,
Line 11, "reciprocably" should read -- reciprocally --.

Column 6,
Line 6, "includes" should be deleted;
Line 29, "exhibit" should read -- exhibits --; and
Line 38, "reciprocably" should read -- reciprocally --.

Column 8,
Line 13, "reciprocably" should read -- reciprocally --; and
Line 58, "another" should read -- other --.

Column 9,
Line 2, "heads Water" should read -- heads. Water --.

Column 10,
Line 39, "reach" should read -- reaches --.

Column 12,
Line 50, "reciprocably" should read -- reciprocally --;
Line 53, "reciprocably" should read -- reciprocally --;
Line 55, "rocably" should read -- rocally --; and
Line 63, "reciprocably" should read -- reciprocally --.

Column 13,
Line 62, "is" should read -- be --.

UNITED STATES PATENT AND TRADEMARK OFFICE

CERTIFICATE OF CORRECTION

PATENT NO. : 6,174,055 B1
DATED : January 16, 2001
INVENTOR(S) : Sugikubo et al.

It is certified that error appears in the above-identified patent and that said Letters Patent is hereby corrected as shown below:

Column 16,
Line 2, "reciprocably" should read -- reciprocally --;
Line 25, "thereon," should read -- thereon; --; and
Line 48, "pump," should read -- pump; --.

Signed and Sealed this

Twenty-sixth Day of March, 2002

*Attest:*

*Attesting Officer*

JAMES E. ROGAN
*Director of the United States Patent and Trademark Office*